US010106348B2

(12) United States Patent
Tomoe et al.

(10) Patent No.: US 10,106,348 B2
(45) Date of Patent: Oct. 23, 2018

(54) SUPPLY UNIT AND IMAGE FORMING APPARATUS

(71) Applicant: CANON KABUSHIKI KAISHA, Tokyo (JP)

(72) Inventors: Kentarou Tomoe, Susono (JP); Yasuhiko Fuse, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/339,507

(22) Filed: Oct. 31, 2016

(65) Prior Publication Data

US 2017/0131674 A1 May 11, 2017

(30) Foreign Application Priority Data

Nov. 5, 2015 (JP) ..... 2015-217188

(51) Int. Cl.
*B65H 3/06* (2006.01)
*G03G 15/00* (2006.01)
*G03G 21/16* (2006.01)

(52) U.S. Cl.
CPC ..... *B65H 3/0684* (2013.01); *G03G 15/6502* (2013.01); *G03G 15/6511* (2013.01); *G03G 21/1695* (2013.01); *B65H 2402/32* (2013.01); *B65H 2601/324* (2013.01); *B65H 2801/12* (2013.01); *G03G 21/1633* (2013.01)

(58) Field of Classification Search
CPC ... B65H 3/0684; B65H 2601/324; B65H 3/06
See application file for complete search history.

(56) References Cited

U.S. PATENT DOCUMENTS

| | | | | |
|---|---|---|---|---|
| 5,421,569 | A * | 6/1995 | Davidson | B65H 3/0669 271/109 |
| 7,487,960 | B2 * | 2/2009 | Wang | B65H 3/0676 271/117 |
| 7,699,312 | B2 * | 4/2010 | Fukuda | B41J 13/009 271/184 |
| 8,925,913 | B2 * | 1/2015 | Kubo | B65H 3/0615 271/117 |
| 9,272,858 | B2 * | 3/2016 | Hirose | B65H 3/0669 |
| 9,340,378 | B2 * | 5/2016 | Ueyama | B65H 5/06 |
| 9,880,505 | B2 * | 1/2018 | Matsumoto | G03G 15/6529 |
| 2009/0072469 | A1 * | 3/2009 | Toba | G03G 15/602 271/10.11 |
| 2009/0242687 | A1 * | 10/2009 | Huang | B65H 27/00 242/566 |

FOREIGN PATENT DOCUMENTS

| | | | |
|---|---|---|---|
| JP | 2000-118743 | A | 4/2000 |
| JP | 2001-26325 | A | 1/2001 |
| JP | 2001-294335 | A | 10/2001 |
| JP | 2008-105813 | A | 5/2008 |

* cited by examiner

*Primary Examiner* — Jeremy R Severson
(74) *Attorney, Agent, or Firm* — Canon USA, Inc. I.P. Division

(57) ABSTRACT

A supply unit holds a supply unit including a pickup roller for supplying a sheet, enables the supply unit including the pickup roller to be installed into an image forming apparatus, and includes a roller-protecting member. The roller-protecting member has a roller-protecting surface that covers the pickup roller of the supply unit and includes engaging pawls that can engage and integrally hold the supply unit including the pickup roller with the roller-protecting surface covering the pickup roller.

12 Claims, 11 Drawing Sheets

SUPPLY UNIT AND IMAGE FORMING APPARATUS

BACKGROUND OF THE INVENTION

Field of the Invention

The present invention relates to a supply unit used when a supplier is installed, an image forming apparatus of, for example, an electrophotographic type or an electrostatic recording type that can use the supply unit, and a supplier installing method.

Description of the Related Art

In a known image forming apparatus, sheets (recording media) stacked in a sheet feed cassette are supplied by a supply roller one by one. A surface of the supply roller (supplier) is subjected to wear and tear and deteriorates through continuous use, and a supply failure may consequently occur. In view of this, in the case where the lifetime of the roller is shorter than the lifetime of an image forming apparatus body (also referred to as an apparatus body below), a user can typically carry out a replacing operation so that the user (operator) can replace the roller with a new one.

An example that enables a user to replace the supply roller is as follows. Japanese Patent Laid-Open No. 2001-294335 proposes a sheet separating and conveying device in which a supply unit, which includes a supply roller and a feed roller, is detachably installed into a device body.

However, with a structure in which the supply unit including the supply roller is detachably installed into the device body as disclosed in Japanese Patent Laid-Open No. 2001-294335, it is difficult for a user to know how to hold the supply unit, and there is a possibility that the user will install the supply unit into the device body while holding a roller portion. When the user touches the roller portion during installation, impurities may become attached to the surface of the roller, which may damage the roller. Consequently, a supply failure may occur.

SUMMARY OF THE INVENTION

The present invention provides a supply unit that enables a user to readily install the supply unit without touching a surface of a supplier during installation and enables a failure in installation to be inhibited during installation of the supplier, and an image forming apparatus that can use the supply unit.

The present invention provides a supply unit that is to be installed into an image forming apparatus. The supply unit includes a supply member that supplies a sheet, a unit body that includes an engaged portion to be engaged and supports the supply member, and a cover member that includes a cover portion that covers the supply member and an engaging portion that is to engage the engaged portion. The supply unit is installed into the image forming apparatus with the engaging portion engaging the engaged portion and the cover portion covering the supply member. The present invention also provides an image forming apparatus in which a supply unit is to be detachably installed. The image forming apparatus includes an installation portion, and a supply unit that is to be installed into the installation portion and includes a supply member that supplies a sheet, a unit body that includes an engaged portion to be engaged and supports the supply member, a cover member that includes a cover portion that covers the supply member and an engaging portion that is to engage the engaged portion. The supply unit is installed into the installation portion with the engaging portion engaging the engaged portion and the cover portion covering the supply member.

Further features of the present invention will become apparent from the following description of exemplary embodiments with reference to the attached drawings.

DESCRIPTION OF THE EMBODIMENTS

First Embodiment

Embodiments of the present invention will hereinafter be described with reference to the drawings. In the description, a positional relationship in the up, down, left, and right directions is represented on the basis of a state where an image forming apparatus 100 is viewed from the front (viewpoint of FIG. 1). A supplier installing method according to the present invention will be described in a description of processing steps in the image forming apparatus 100.

Structure of Image Forming Apparatus and Image Forming Process

Figure 1:
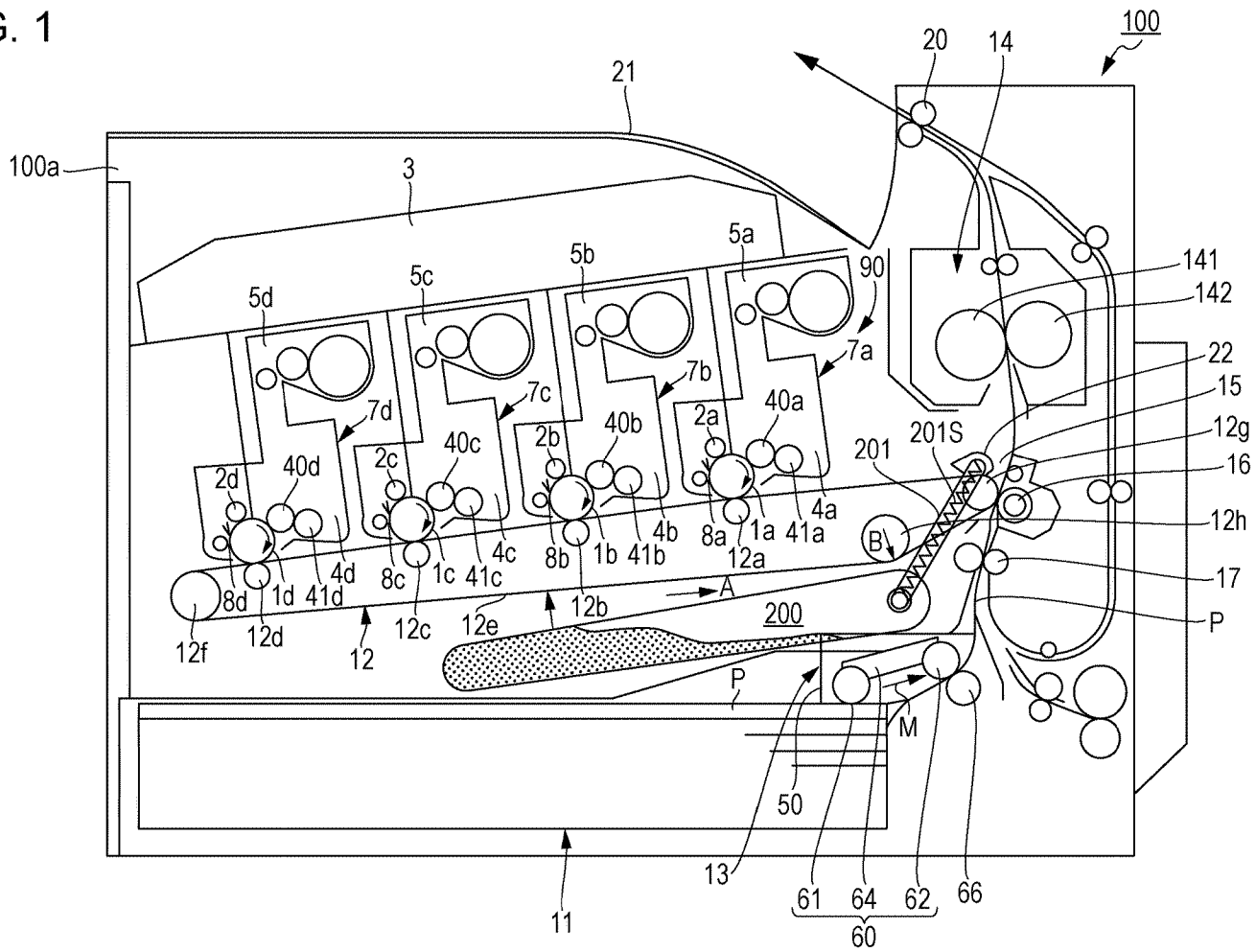
FIG. 1 is a schematic view of an image forming apparatus according to a first embodiment of the present invention.

The structure of the image forming apparatus 100 and imaging processes according to the first embodiment of the present invention will now be described. FIG. 1 is a schematic sectional view of the image forming apparatus 100 according to the first embodiment.

As illustrated in FIG. 1, the image forming apparatus 100 includes an image forming apparatus body 100*a* (also referred to as an apparatus body below) and process cartridges 7*a*, 7*b*, 7*c*, and 7*d* that are attachable to and detachable from the apparatus body 100*a*. The four process cartridges 7*a* to 7*d* have the same structure but differ in forming images of different colors, that is, yellow (Y), magenta (M), cyan (C), and black (Bk) toners. The process cartridges 7*a* to 7*d* each include development units 4*a*, 4*b*, 4*c*, and 4*d* and toner units 5*a*, 5*b*, 5*c*, and 5*d*.

The development units 4*a*, 4*b*, 4*c*, and 4*d* each include photosensitive drums 1*a*, 1*b*, 1*c*, and 1*d*, which are image-bearing members, charge rollers 2*a*, 2*b*, 2*c*, and 2*d*, drum cleaning blades 8*a*, 8*b*, 8*c*, and 8*d*, and a waste-toner container. The development units 4*a*, 4*b*, 4*c*, and 4*d* also include development rollers 40*a*, 40*b*, 40*c*, and 40*d* and developer-applying rollers 41*a*, 41*b*, 41*c*, and 41*d*. A scanner unit 3 is disposed above the process cartridges 7*a*, 7*b*, 7*c*, and 7*d*. The scanner unit 3 exposes the photosensitive drums 1*a*, 1*b*, 1*c*, and 1*d* to light on the basis of image signals.

The photosensitive drums 1*a*, 1*b*, 1*c*, and 1*d* are charged by the charge rollers 2*a*, 2*b*, 2*c*, and 2*d* at a predetermined potential having a negative polarity. Electrostatic latent images are then formed on the photosensitive drums by the scanner unit 3. The electrostatic latent images are subjected to reversal development by the corresponding development units 4*a*, 4*b*, 4*c*, and 4*d*, and toners having a negative polarity are attached thereto, forming toner images of Y, M, C, and Bk thereon.

In an intermediate transfer belt unit 12, an intermediate transfer belt 12*e* is tightly stretched around a drive roller 12*f*, an opposing secondary-transfer roller 12*g*, and a tension roller 12*h*. The tension roller 12*h* applies tension in the direction of arrow B. Primary transfer rollers 12*a*, 12*b*, 12*c*, and 12*d* are disposed inside the intermediate transfer belt 12*e* so as to oppose the photosensitive drums 1*a*, 1*b*, 1*c*, and 1*d*. A bias applying unit, not illustrated, applies transfer bias.

In the image forming apparatus 100, a supply unit 600, described later, enables a supply unit 60 to be installed (replaced). The image forming apparatus 100 includes a sheet feed cassette 11 (sheet-containing unit) and an image-forming unit 90 that forms an image on a sheet supplied from the sheet feed cassette 11. The sheet feed cassette 11 is to be installed into and to be drawn from the apparatus body 100*a* and contains sheets P (recording materials) to be supplied by using a pickup roller 61.

The photosensitive drums rotate in the direction of arrows. The intermediate transfer belt 12*e* rotates in the direction of arrow A. Bias having a positive polarity is applied to the primary transfer rollers 12*a*, 12*b*, 12*c*, and 12*d*. The toner images formed on the photosensitive drums 1*a*, 1*b*, 1*c*, and 1*d* are primarily transferred successively on the intermediate transfer belt 12*e* starting from the toner image on the photosensitive drum 1*a*. The overlapping four-color toner images are conveyed to a secondary transfer unit 15.

The sheet P conveyed from a sheet-supplying device 13 passes through a pair of registration rollers 17 and is conveyed to the secondary transfer unit 15. The sheet-supplying device 13 includes the supply unit 60 and a retard roller 66 serving as a separation unit (separation roller) that faces a feed roller 62 and is in pressure contact with the feed roller 62. The supply unit 60 includes the pickup roller 61 serving as a supplier (supply roller) that supplies the sheet P from the inside of the sheet feed cassette 11 containing the sheets P and the feed roller 62 serving as a conveyor (conveyance roller) that conveys the supplied sheet. The supply unit 60 also includes an idler gear 63, described later, and a supply holder 64 that holds these. The detail of the sheet-supplying device 13 is described later.

At the secondary transfer unit 15, bias having a positive polarity is applied to a secondary transfer roller 16 to secondarily transfer the four-color toner images formed on the intermediate transfer belt 12*e* to the conveyed sheet P. The sheet P on which the toner images are transferred is conveyed to a fixing device 14, heated and pressed by a fixing roller 141 and a pressure roller 142, and fixed on a surface of the sheet. The sheet P on which the toner images are fixed is discharged to a discharge tray 21 by a pair of discharge rollers 20. Residual toners remaining on the surfaces of the photosensitive drums 1*a*, 1*b*, 1*c*, and 1*d* after the toner images are transferred are removed by the cleaning blades 8*a*, 8*b*, 8*c*, and 8*d*, respectively. A residual toner remaining on the intermediate transfer belt 12*e* after the secondary transfer to the sheet P is removed by a transfer-belt-cleaning device 22. The removed toners pass through a waste-toner conveyance path 201 and are collected in a waste-toner container 200.

Structure of Sheet-Supplying Device

Figure 2A:
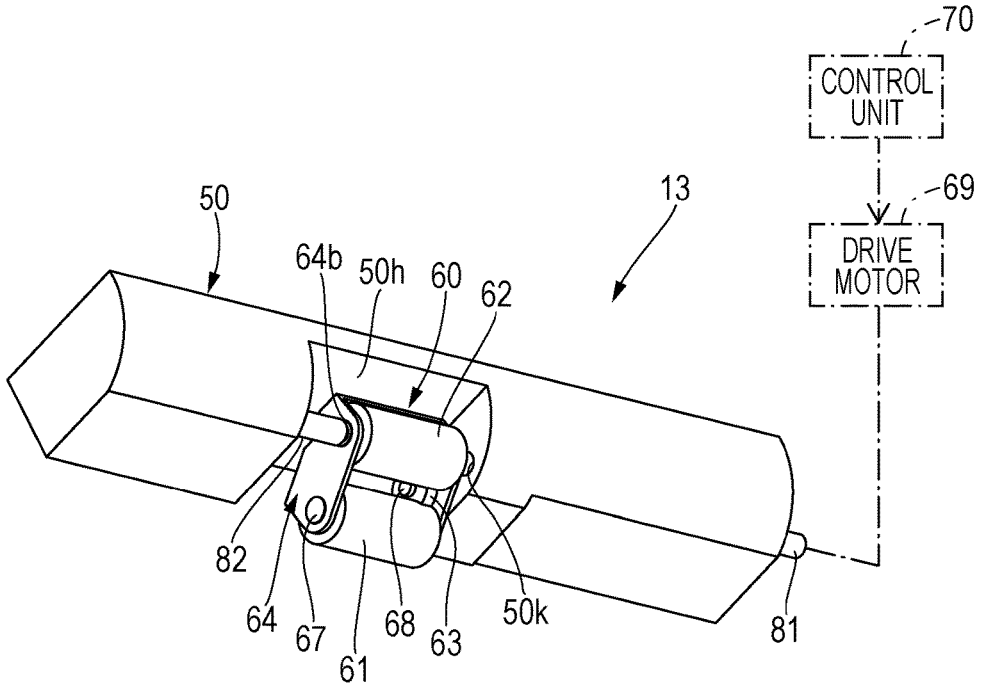
FIG. 2A is a perspective view of a sheet-supplying device according to the first embodiment viewed from below.
Figure 2B:
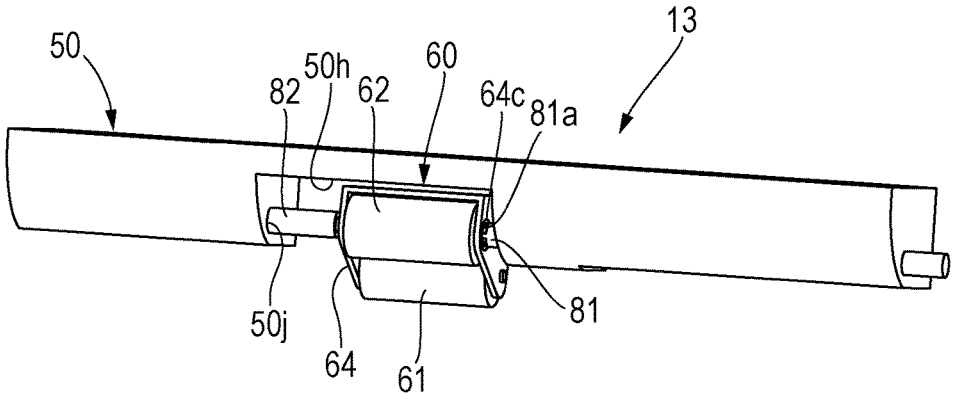
FIG. 2B is a perspective view of the sheet-supplying device illustrated in FIG. 2A viewed at a different angle.
Figure 3:
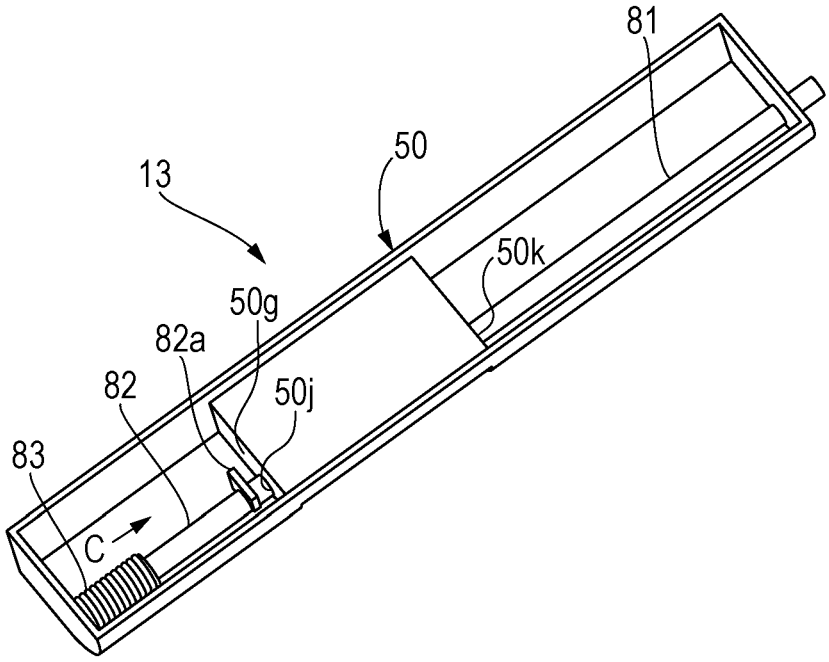
FIG. 3 is a perspective view of the sheet-supplying device illustrated in FIG. 2A viewed from above.

The detailed structure of the sheet-supplying device 13 according to the first embodiment will now be described. FIG. 2A is a perspective view of the sheet-supplying device 13 according to the first embodiment viewed from below. FIG. 2B is a perspective view of the sheet-supplying device 13 illustrated in FIG. 2A viewed at a different angle. FIG. 3 is a perspective view of the sheet-supplying device 13 illustrated in FIG. 2B viewed from above.

As illustrated in FIG. 2A, FIG. 2B, and FIG. 3, the sheet-supplying device 13 includes a supply frame 50 that is secured to the apparatus body 100*a* and the supply unit 60 that is supported by the supply frame 50 and supplies the sheet P from the inside of the sheet feed cassette 11. The supply frame 50 includes a supply drive shaft 81 and a slide shaft 82 that detachably support the supply unit 60 and a coil spring 83 formed of a compression spring that urges the slide shaft 82 in the direction of arrow C. The slide shaft 82 is supported slidably with respect to the supply frame 50 in the direction of arrow C.

The supply unit 60 includes the pickup roller 61 (supplier), the feed roller 62 (conveyor), the idler gear 63 that is supported by a shaft 68 and transmits a driving force of the feed roller 62 to the pickup roller 61, and the supply holder 64. The supply holder 64 supports the pickup roller 61, the feed roller 62, and the idler gear 63. The supply holder 64 has a through-hole 64*b* formed such that the through-hole 64*b* faces a sliding end portion 82*c* (see FIG. 6A to FIG. 6D) of the slide shaft 82 and a through-hole 64*c* formed such that the through-hole 64*c* faces an engaging end portion 81*a* of the supply drive shaft 81. The feed roller 62 has a slide hole 62*a* (see FIG. 6A to FIG. 6D) formed such that the slide hole 62*a* faces the sliding end portion 82*c* of the slide shaft 82 and an engagement hole 62*b* (see FIG. 6A to FIG. 6D) formed such that the engagement hole 62*b* faces the engaging end portion 81*a* of the supply drive shaft 81.

The pickup roller 61 is rotatably supported by the supply holder 64 at a rotating shaft 67. The feed roller 62 is supported from both ends in the axial direction by the supply drive shaft 81 and the slide shaft 82. The supply frame 50 elongates in the axial direction and can receive the supply drive shaft 81 and the slide shaft 82. At a central portion thereof, a recessed portion 50*h* is formed, and the supply unit 60 is moveably accommodated in the recessed portion 50*h*. Through-holes 50*j* and 50*k* are formed so as to extend from the inside of the supply frame 50 and to be connected to a space in the recessed portion 50*h*. The supply unit 60 is rotatably accommodated in the recessed portion 50*h* of the supply frame 50 while being supported at both ends of the feed roller 62 by the slide shaft 82 and the supply drive shaft 81 that are respectively inserted into the through-holes 50*j* and 50*k*.

The sliding end portion 82*c* of the slide shaft 82 is inserted into the slide hole 62*a* (see FIG. 6D) formed in an end portion of the feed roller 62 in the axial direction. The feed roller 62 is supported by the shafts rotatably with respect to the slide shaft 82. The engaging end portion 81*a* of the supply drive shaft 81 is inserted into the engagement hole 62*b* (see FIG. 6D) formed in the other end portion of the feed roller 62 in the axial direction. The feed roller 62 is supported by the shafts such that the feed roller 62 cannot rotate with respect to the supply drive shaft 81.

As illustrated in FIG. 2A, a drive motor 69 that transmits rotation to the supply drive shaft 81 and causes the feed roller 62 to rotate, and a control unit 70 that includes CPU, RAM, and ROM and controls the drive motor 69 are disposed in the apparatus body 100*a* (see FIG. 1). When the drive motor 69 driven by control of the control unit 70 causes the feed roller 62 to rotate, the rotation is transmitted to the pickup roller 61 via the idler gear 63, causing the pickup roller 61 to rotate in the same direction as the feed roller 62 rotates. This enables the sheet in the sheet feed cassette 11 to be supplied.

As illustrated in FIG. 3, the slide shaft 82 is urged by the coil spring 83 in the direction of arrow C. When a slide stopping portion 82*a* formed on the slide shaft 82 so as to protrude comes into contact with a slide-stopped portion 50*g* formed on the supply frame 50, the slide shaft 82 stops at the position illustrated in FIG. 6A. The feed roller 62 is pressed toward the side of the supply drive shaft 81 by using the slide shaft 82 urged by the coil spring 83, and the supply unit 60 is thereby rotatably supported by the supply frame 50.

Structure of Supply Unit and Vicinity Thereof

Figure 4:
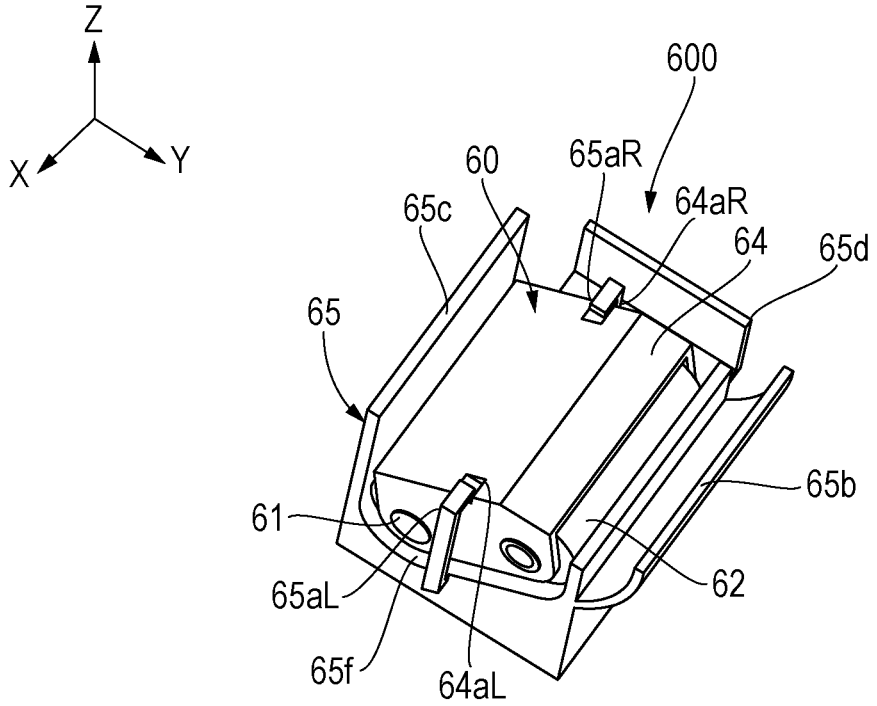
FIG. 4 is a perspective diagram illustrating the appearance of a supply unit according to the first embodiment.
Figure 5:
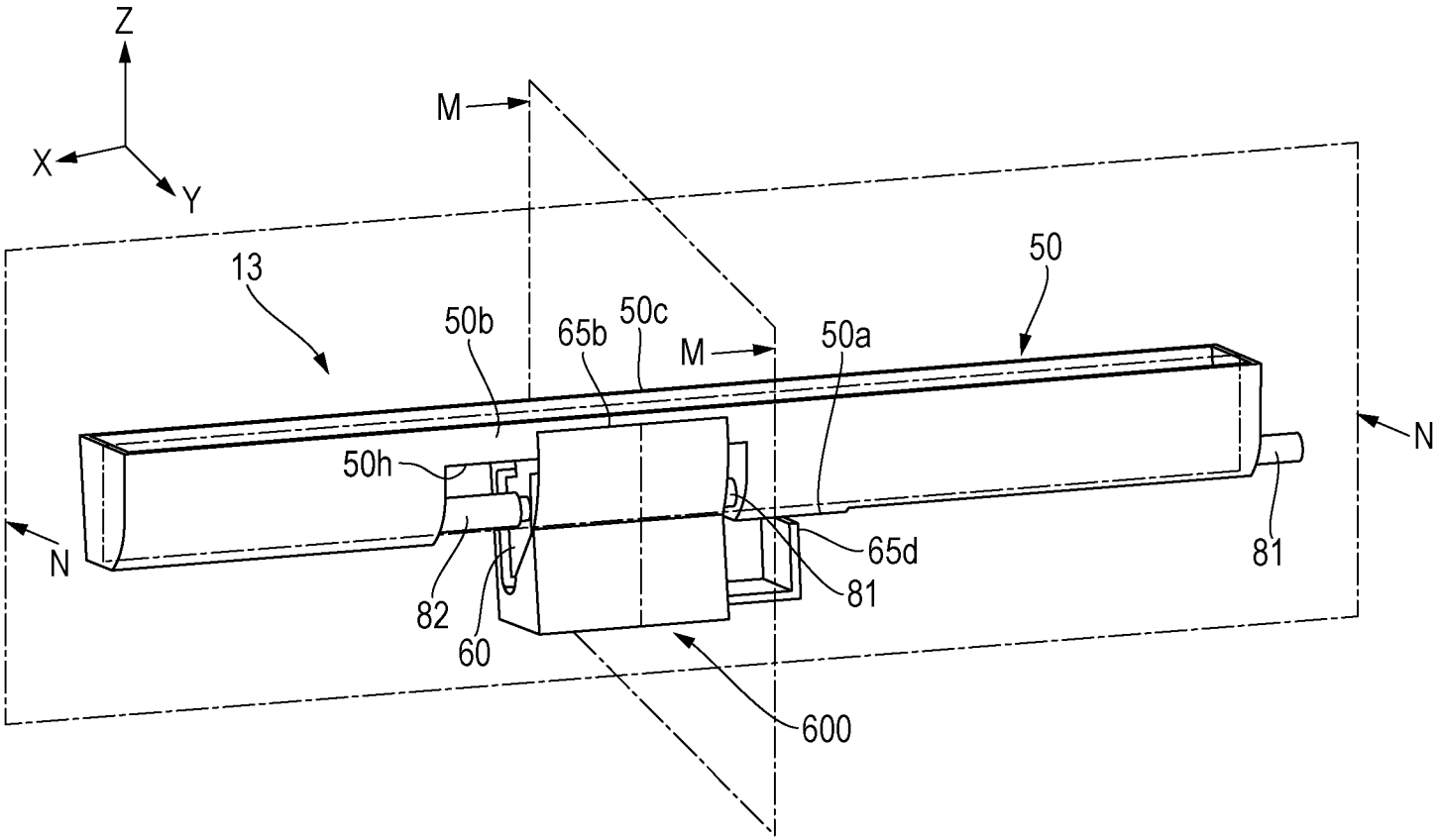
FIG. 5 is a perspective diagram illustrating the appearance of the supply unit and the sheet-supplying device according to the first embodiment.

The structure of the supply unit 600 according to the first embodiment and the vicinity thereof will now be described with reference to FIG. 4 and FIG. 5. FIG. 4 is a perspective diagram illustrating the appearance of the supply unit 600 according to the first embodiment. FIG. 5 is a perspective diagram illustrating the appearance of the supply unit 600 and the sheet-supplying device 13.

As illustrated in FIG. 4 and FIG. 5, the supply unit 600 holds the supply unit 60, which includes the pickup roller 61 that supplies the sheet and the feed roller 62, for installation (replacement) and enables the supply unit 60 to be installed into the image forming apparatus 100 (detached from the image forming apparatus 100 and replaced) The supply unit 600 includes a roller-protecting member 65 (cover member). The roller-protecting member 65 has a roller-protecting surface 65*f* (cover portion) that covers the pickup roller 61 of the supply unit 60. The roller-protecting member 65 includes engaging pawls 65*a*L and 65*a*R (engaging portions) that can engage and integrally hold the supply unit 60 with the roller-protecting surface 65*f* covering the pickup roller 61. When the supply unit 60 has been installed into the supply frame 50 (installation portion) disposed on the image forming apparatus 100, the engaging pawls 65*a*L and 65*a*R (engaging portions) are disengaged and the roller-protecting member 65 is thereby detached from the supply unit 60.

The roller-protecting surface 65*f* (cover portion) of the roller-protecting member 65 is formed in a curved shape and covers the entire surface of the pickup roller 61 and the feed roller 62. The engaging pawls 65*a*L and 65*a*R are formed so as to protrude from left and right edge portions of the roller-protecting surface 65*f*. Bases of the engaging pawls 65*a*L and 65*a*R are formed integrally with the roller-protecting member 65, and pawl portions at free ends are flexible and bendable. Engagement recessed portions 64*a*L and 64*a*R are formed in both end portions of the upper surface of the supply unit 60.

The supply unit 60 includes the supply holder 64 that holds the pickup roller 61 (supplier) and the feed roller 62 (conveyor) that conveys the sheet P supplied by the pickup roller 61 to a downstream side in the direction in which the sheet is conveyed (direction of arrow M in FIG. 1). The supply unit 60 is held by the roller-protecting member 65 in a manner in which the engaging pawls 65*a*L and 65*a*R formed on the roller-protecting member 65 respectively engage the engagement recessed portions 64*a*L and 64*a*R, and can be detached from the roller-protecting member 65 in a manner in which the engaging pawls 65*a*L and 65*a*R disengage from the engagement recessed portions 64*a*L and 64*a*R.

As illustrated in FIG. 4 and FIG. 5, the supply frame 50 includes guided portions 50*b* and 50*c* above the recessed portion 50*h* located at a central portion in the longitudinal direction and restricted portions 50*a* at lower portions on both sides of the recessed portion 50*h*. The roller-protecting member 65 includes positioning guiding portions 65*b* and 65*c* (positioning contact portions) and a positioning restricting portion 65*d* (positioning contact portion). When the supply unit 60 held by the engaging pawls 65*a*L and 65*a*R is installed into the supply frame 50, the positioning guiding portions 65*b* and 65*c* and the positioning restricting portion 65*d* come into contact with the supply frame 50, and the position of the supply unit 60 with respect to the supply frame 50 is thereby set.

The positioning guiding portions 65*b* and 65*c* function as restricting units that restrict the guided portions 50*b* and 50*c* of the supply frame 50 in the direction (+Y) of arrow Y and the direction (−Y) opposite the direction of arrow Y. The positioning restricting portion 65*d* functions as a restricting unit that restricts one of the restricted portions 50*a* of the supply frame 50 in the direction of arrow Z. The positioning guiding portion 65*c* is formed so as to protrude and comes into contact with and engages the guided portion 50*c* of the supply frame 50 from the direction of arrow Y. The positioning guiding portion 65*b* is formed so as to slightly curve and protrude and comes into contact with and engages the guided portion 50*b* from the direction opposite the direction of arrow Y (see FIG. 7A to FIG. 7D). The positioning restricting portion 65*d* is formed so as to protrude and comes into contact with one of the restricted portions 50*a* of the supply frame 50 from the direction of arrow Z (see FIG. 7B and FIG. 7D).

Supply Unit Installation

Figure 6A:
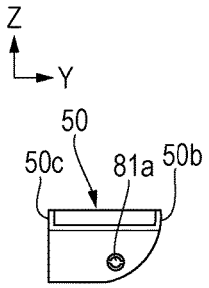
FIG. 6A is a sectional view of FIG. 5 along line M-M, in the direction of arrows.
Figure 6B:
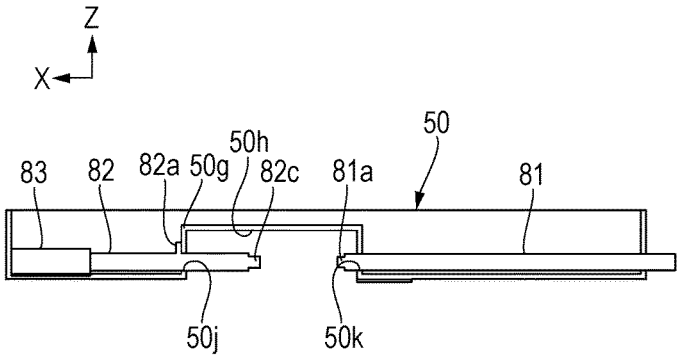
FIG. 6B is a sectional view of FIG. 5 along line N-N, in the direction of arrows.
Figure 6C:
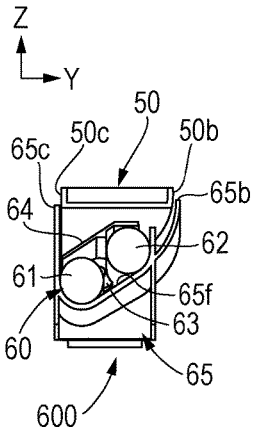
FIG. 6C is a sectional view of FIG. 5 along line M-M, in the direction of the arrows, when a sliding end portion of a slide shaft is inserted into a slide hole of a feed roller.
Figure 6D:
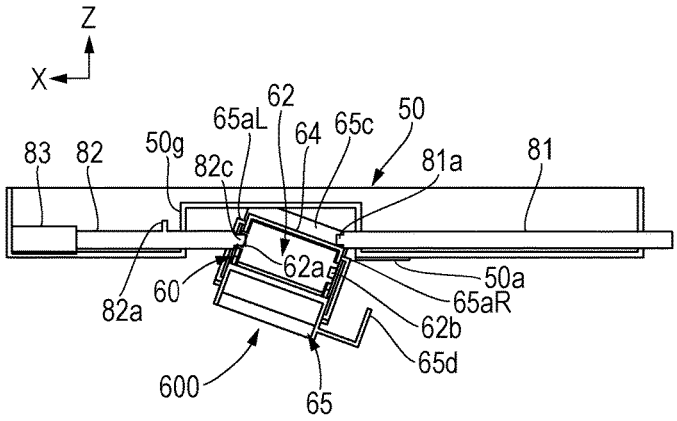
FIG. 6D is a sectional view of FIG. 5 along line N-N, in the direction of the arrows, when the sliding end portion of the slide shaft is inserted into the slide hole of the feed roller.

Installation of the supply unit 60 into the supply frame 50 of the sheet-supplying device 13 according to the first embodiment will now be described. FIG. 6A to FIG. 6D are sectional views of FIG. 5 after the sheet feed cassette 11 is drawn from the apparatus body 100*a* and the supply unit 60 is detached from the sheet-supplying device 13. FIG. 6A is a sectional view of FIG. 5 along line M-M, in the direction of arrows. FIG. 6B is a sectional view of FIG. 5 along line N-N, in the direction of arrows. FIG. 6C is a sectional view of FIG. 5 along line M-M, in the direction of the arrows, when the sliding end portion 82*c* of the slide shaft 82 is inserted into the slide hole 62*a* of the feed roller 62. FIG. 6D is a sectional view of FIG. 5 along line N-N, in the direction of the arrows, when the sliding end portion 82*c* of the slide shaft 82 is inserted into the slide hole 62*a* of the feed roller 62.

As illustrated in FIG. 6A to FIG. 6D, the slide shaft 82 (first support shaft) is disposed in the supply frame 50 and urged such that the sliding end portion 82*c* can be inserted into the slide hole 62*a* of the feed roller 62 (conveyance roller) formed at an end thereof. The supply drive shaft 81 (second support shaft), whose engaging end portion 81*a* can engage the engagement hole 62*b* of the feed roller 62 formed at the other end thereof, is disposed in the supply frame 50. The slide shaft 82 slides as a result of being urged in the −X direction (direction opposite the X direction) by the coil spring 83. When the slide stopping portion 82*a* of the slide shaft 82 comes into contact with the slide-stopped portion 50*g*, the slide shaft 82 stops at the position illustrated in FIG. 6B. In this state, the slide shaft 82 is caused to slide in the direction of arrow X against the urging force of the coil spring 83, and the supply unit 60 installed as illustrated in FIG. 2A and FIG. 2B can thereby be detached from the sheet-supplying device 13.

In a state in which the supply unit 60 including the pickup roller 61 subjected to wear and tear is detached from the supply frame 50, another supply unit 60 including a new pickup roller 61 for replacement thereof is installed into the supply frame 50. At this time, an operator inserts the sliding end portion 82*c* into the slide hole 62*a* of the feed roller 62 and inserts the engaging end portion 81*a* into the engagement hole 62*b* of the feed roller 62 while gripping the roller-protecting member 65 holding the supply holder 64. At this time, the engaging end portion 81*a* can properly mesh with a keyway of the engagement hole 62*b* in a manner in which the supply drive shaft 81 is slightly rotated, for example, through manual operation, and the supply unit 60 can be properly installed into the supply frame 50 with the feed roller 62 interposed therebetween.

As illustrated in FIG. 6C and FIG. 6D, the sliding end portion 82*c* of the slide shaft 82 is inserted into the slide hole 62*a* of the feed roller 62 of the supply unit 600 in the state illustrated in FIG. 6A and FIG. 6B. At this time, the positioning guiding portions 65*b* and 65*c* of the roller-protecting member 65 are in contact with the guided portions 50*b* and 50*c* of the supply frame 50, and movement of the supply unit 600 in the direction of arrow Y and in the opposite direction is thereby restricted. The position in the direction of arrow Z can be somewhat adjusted without restriction by visually inspecting the slide hole 62*a* and the sliding end portion 82*c* and adjusting accordingly. Accordingly, the restriction on the movement in the direction of arrow Y and in the opposite direction eliminates the misalignment of the slide hole 62*a* and the sliding end portion 82*c*, and the sliding end portion 82*c* can be readily inserted into the slide hole 62*a*.

Figure 7A:
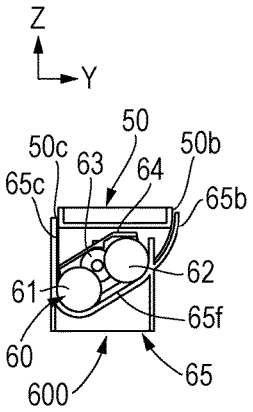
FIG. 7A is a sectional view of FIG. 5 along line M-M, in the direction of the arrows, before the supply unit is installed in a normal state with respect to the sheet-supplying device.
Figure 7B:
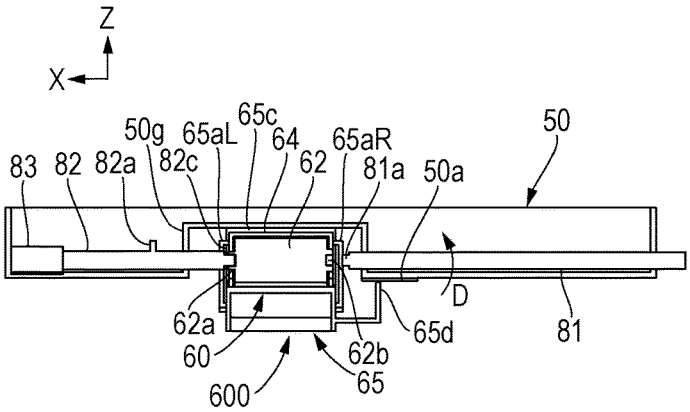
FIG. 7B is a sectional view of FIG. 5 along line N-N, in the direction of the arrows, before the supply unit is installed in a normal state with respect to the sheet-supplying device.

FIG. 7A and FIG. 7B are sectional views of FIG. 5 before the supply unit 600 is installed in a normal state with respect to the sheet-supplying device 13. In the state illustrated in FIG. 6C and FIG. 6D, the supply unit 600 is swung in the direction of arrow D (FIG. 7B) on the side of the supply drive shaft 81, for example, through manual operation while the supply unit 600 and the slide shaft 82 are caused to slide in the +X direction (direction of arrow X) against the urging force of the coil spring 83.

At this time, the positioning guiding portions 65*b* and 65*c* of the roller-protecting member 65 are in contact with the guided portions 50*b* and 50*c* of the supply frame 50, and the movement in the +Y direction and in the −Y direction is thereby restricted. The positioning restricting portion 65*d* of the roller-protecting member 65 is in contact with one of the restricted portions 50*a* of the supply frame 50, and the movement in the direction of arrow Z is thereby restricted. At this time, the engagement hole 62*b* of the feed roller 62 is coaxial with the engaging end portion 81*a* of the supply drive shaft 81, and accordingly, the engaging end portion 81*a* can readily engage the engagement hole 62*b* in a subsequent process.

Figure 7C:
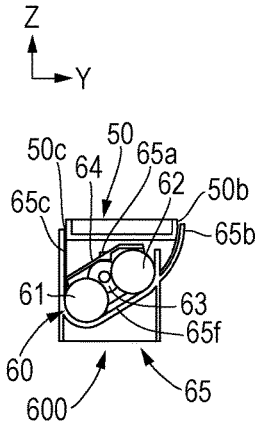
FIG. 7C is a sectional view of FIG. 5 along line M-M, in the direction of the arrows, when the supply unit is installed into the sheet-supplying device.
Figure 7D:
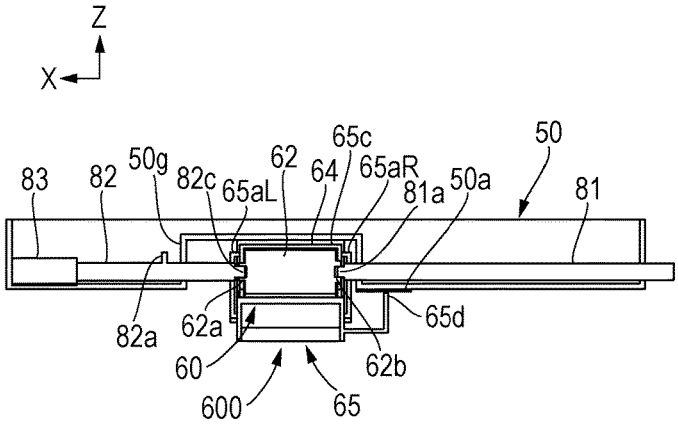
FIG. 7D is a sectional view of FIG. 5 along line N-N, in the direction of the arrows, when the supply unit is installed into the sheet-supplying device.

FIG. 7C and FIG. 7D are sectional views of FIG. 5 when the supply unit 600 is installed into the supply frame 50 of the sheet-supplying device 13. When the operator releases their grip to relieve the force acting against the urging force of the coil spring 83 in the state illustrated in FIG. 7A and FIG. 7B, the urging force of the coil spring 83 causes the supply unit 600 and the slide shaft 82 to move in the −X direction. In this way, the engaging end portion 81*a* of the supply drive shaft 81 properly engages the engagement hole 62*b* of the feed roller 62, and the supply unit 600 is installed into the sheet-supplying device 13 in a normal state.

Figure 8A:
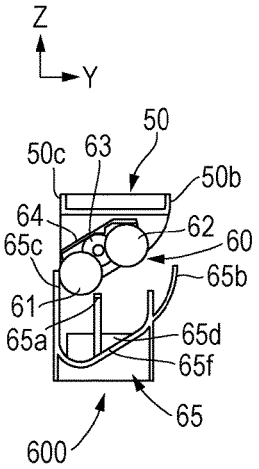
FIG. 8A is a sectional view of FIG. 5 along line M-M, in the direction of the arrows, when a roller-protecting member is detached from the supply unit.
Figure 8B:
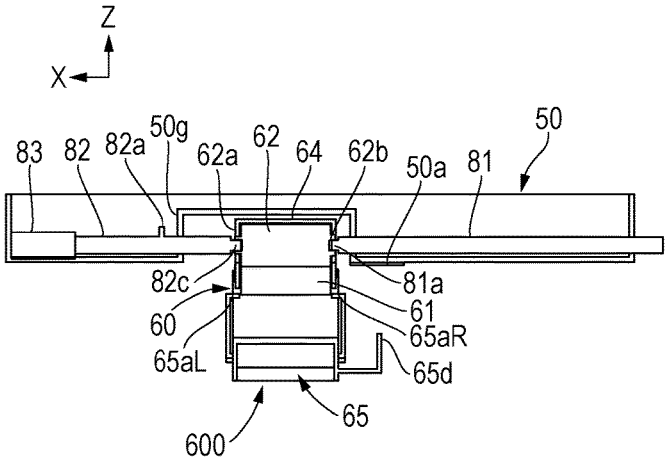
FIG. 8B is a sectional view of FIG. 5 along line M-M, in the direction of the arrows, when the roller-protecting member is detached from the supply unit.

FIG. 8A and FIG. 8B are sectional views of FIG. 5 when the roller-protecting member 65 is detached from the supply unit 60. In the state illustrated in FIG. 7C and FIG. 7D, an operator moves the roller-protecting member 65 in the −Z direction (downward direction in FIG. 8A and FIG. 8B) with a force acting against the engagement of the engaging pawl 65*a*L and the engagement recessed portion 64*a*L and the engagement of the engaging pawl 65*a*R and the engagement recessed portion 64*a*R. In this way, the engaging pawl 65*a*L disengages from the engagement recessed portion 64*a*L, and the engaging pawl 65*a*R disengages from the engagement recessed portion 64*a*R. Consequently, the roller-protecting member 65 is detached from the supply unit 60, and, in this state, only the supply unit 60 is installed into the supply frame 50. Thus, the roller-protecting member 65 (cover member) is detached from the supply unit 60 by using the operator-applied operating force acting against the engaging force of the engaging pawls 65*a*L and 65*a*R (engaging portions) engaging the engagement recessed portions 64*a*L and 64*a*R (engaged portions).

Figure 9:
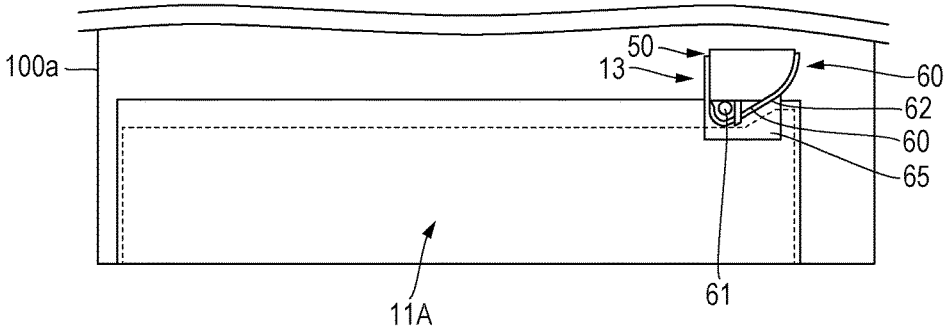
FIG. 9 is a front view of the sheet-supplying device of the image forming apparatus according to the first embodiment and the vicinity thereof.

FIG. 9 is a front view of the apparatus body 100*a* illustrating a state where the sheet feed cassette 11 is drawn from the apparatus body 100*a*, and the roller-protecting member 65 is installed into the sheet-supplying device 13. As illustrated in FIG. 9, the supply frame 50 is formed such that, in the case where the roller-protecting member 65 is not detached from the supply unit 60, the roller-protecting member 65 is located on a track of the sheet feed cassette 11 to be installed when the sheet feed cassette 11 is drawn from the apparatus body 100*a*. Accordingly, when the sheet feed cassette 11 is inserted, the sheet feed cassette 11 interferes with the roller-protecting member 65 that is not detached.

In other words, the roller-protecting member 65 installed into the sheet-supplying device 13 is disposed so as to protrude toward an area 11A in which the sheet feed cassette 11 is to be located. Accordingly, the sheet feed cassette 11 interferes with the roller-protecting member 65 while the sheet feed cassette 11 is being inserted into the area 11A and stops, even when an operator forgets to detach the roller-protecting member 65 from the supply unit 600. This reminds the operator that the roller-protecting member 65 has not yet detached. This is the same as in the case of a roller-protecting member 75 (cover member) according to a second embodiment described later.

In the first embodiment, the roller-protecting member 65 has the roller-protecting surface 65*f* that covers the rollers 61 and 62 and includes the engaging pawls 65*a*L and 65*a*R that can engage and integrally hold the supply unit 60 with the roller-protecting surface 65*f* covering the rollers 61 and 62. Accordingly, the roller-protecting member 65 enables an operator to inhibit from touching the surface of the pickup roller 61 during installation of the supply unit 60. This eliminates surface stains of the pickup roller 61 and the feed roller 62 and the occurrence of a supply failure. In addition, the roller-protecting member 65 functions as a guide during installation. This facilitates the operation by an operator and enables the operator to avoid a failure in installation. These effects are the same as in the second embodiment described later.

The engaging pawls 65*a*L and 65*a*R are disengaged to detach the roller-protecting member 65 when the supply unit 60 has been installed into the supply frame 50. Accordingly, the roller-protecting member 65 can be detached through a simple operation after the supply unit 60 is installed. The roller-protecting member 65 can be detached by using the operator-applied operating force acting against the engaging force of the engaging pawls 65*a*L and 65*a*R engaging the engagement recessed portions 64*a*L and 64*a*R. Accordingly, the detachment of the roller-protecting member 65 becomes easier.

The supply unit 60 includes the supply holder 64 that holds the feed roller 62 and the pickup roller 61. The engaging pawls 65*a*L and 65*a*R engage the engagement recessed portions 64*a*L and 64*a*R of the supply holder 64 and thereby integrally hold the supply unit 60. Accordingly, the supply unit 60 can be stably held by the roller-protecting member 65. This is the same as in the second embodiment described later.

When the supply unit 60 is installed into the supply frame 50, an operator can insert the sliding end portion 82*c* into the slide hole 62*a* of the feed roller 62 and insert the engaging end portion 81*a* into the engagement hole 62*b* of the feed roller 62 while gripping the roller-protecting member 65 holding the supply holder 64. This enables the supply unit 60 to be properly installed into the supply frame 50 with the feed roller 62 interposed therebetween. This is the same as in the second embodiment described later.

The roller-protecting member 65 includes the positioning guiding portions 65*b* and 65*c* and the positioning restricting portion 65*d* that come into contact with the supply frame 50 and thereby set the position of the supply unit 60 with respect to the supply frame 50 when the supply unit 60 held by the engaging pawls 65*a*L and 65*a*R is installed into the supply frame 50. Accordingly, when the supply unit 60 is installed into the supply frame 50, the position of the supply unit 60 with respect to the supply frame 50 can be successfully set in a manner in which the positioning guiding portions 65*b* and 65*c* and the positioning restricting portion 65*d* are brought into contact with the supply frame 50. This is the same as in the second embodiment described later.

Second Embodiment

The second embodiment of the present invention will now be described with reference to FIG. 10, FIG. 11, and FIG. 13A to FIG. 13C. In the second embodiment, like symbols designate like components to those in the first embodiment, and a description of components having the same structure and function as in the first embodiment is omitted.

Structure of Supply Unit and Vicinity Thereof

Figure 10:
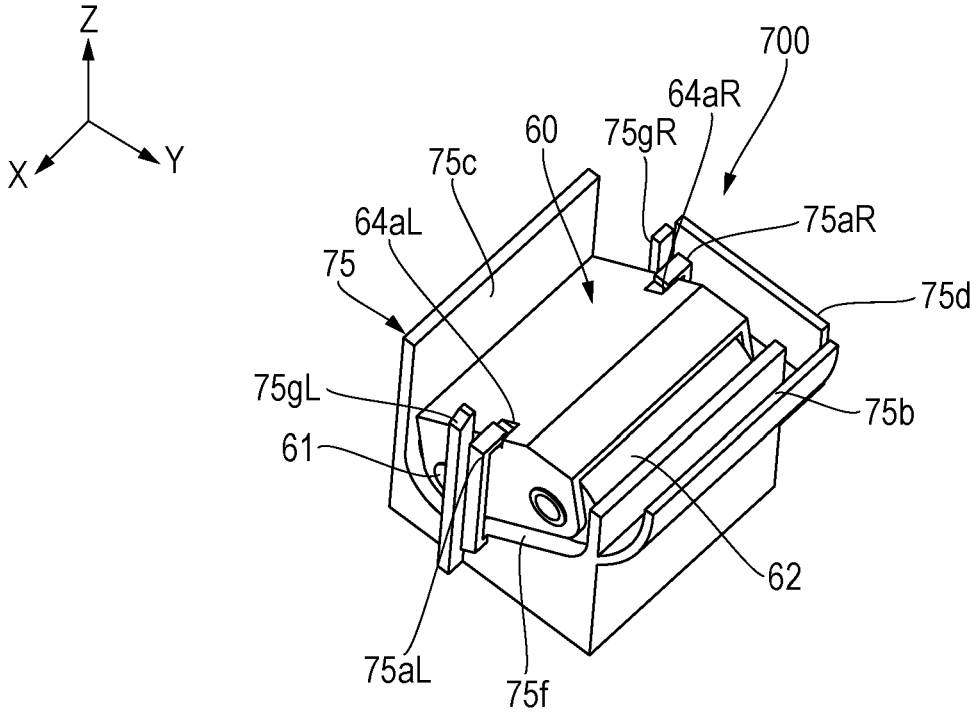
FIG. 10 is a perspective diagram illustrating the appearance of a supply unit according to a second embodiment.
Figure 11:
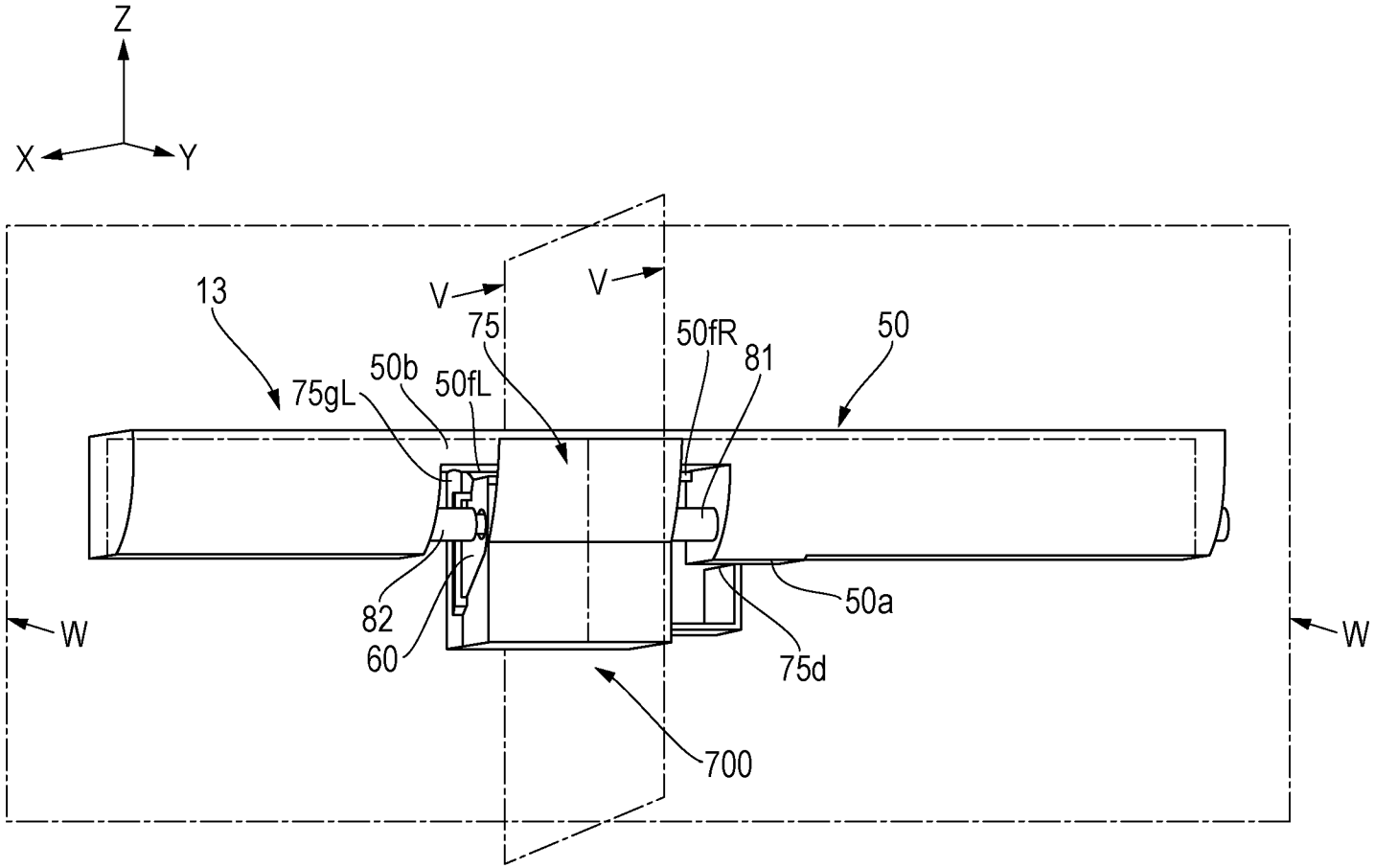
FIG. 11 is a perspective diagram illustrating the appearance of the supply unit and a sheet-supplying device according to the second embodiment.

The structure of a supply unit 700 according to the second embodiment and the vicinity thereof will now be described with reference to FIG. 10 and FIG. 11. FIG. 10 is a perspective diagram illustrating the appearance of the supply unit 700 according to the second embodiment. FIG. 11 is a perspective diagram illustrating the appearance of the supply unit 700 and a sheet-supplying device 13 according to the second embodiment.

As illustrated in FIG. 10 and FIG. 11, the supply unit 700 according to the second embodiment includes a supply unit 60 having the same structure as described in the first embodiment and the roller-protecting member 75 (cover member) that is mounted on the supply unit 60.

The roller-protecting member 75 according to the second embodiment includes a roller-protecting portion 75*f* (cover portion) and engaging pawls 75*a*L and 75*a*R (engaging portions). The roller-protecting portion 75*f* is formed in a curved shape and covers the entire surface of the pickup roller 61 and the feed roller 62. The engaging pawls 75*a*L and 75*a*R are formed so as to protrude from left and right edge portions of the roller-protecting portion 75*f*. The engaging pawls 75*a*L and 75*a*R formed integrally with the roller-protecting member 75 are flexible. The engaging pawls 75*a*L and 75*a*R respectively engage the engagement recessed portions 64*a*L and 64*a*R formed in the supply unit 60 and thereby detachably hold the supply unit 60.

The supply frame 50 includes the guided portions 50*b* and 50*c* above the recessed portion 50*h* located at a central portion in the longitudinal direction and the restricted portions 50*a* at the lower portions on both sides of the recessed portion 50*h*. The supply frame 50 also includes protrusions 50*f*L and 50*f*R on the upper surface of the recessed portion 50*h*.

The roller-protecting member 75 includes positioning guiding portions 75*b* and 75*c* (positioning contact portions) serving as restricting units that restrict the guided portions 50*b* and 50*c* of the supply frame 50 in the direction of arrow Y and in the opposite direction. The roller-protecting member 75 also includes a positioning restricting portion 75*d* (positioning contact portion) serving as a restricting unit that restricts one of the restricted portions 50*a* of the supply frame 50 in the direction of arrow Z. The positioning guiding portion 75*c* is formed so as to protrude and comes into contact with and engages the guided portion 50*c* of the supply frame 50 from the direction of arrow Y. The positioning guiding portion 75*b* is formed so as to slightly curve and protrude and comes into contact with and engages the guided portion 50*b* from the direction opposite the direction of arrow Y (see FIG. 12A to FIG. 12D). The positioning restricting portion 75*d* is formed so as to protrude and comes into contact with one of the restricted portions 50*a* of the supply frame 50 from the direction of arrow Z (see FIG. 13B and FIG. 13D).

Supply Unit Installation

Figure 12A:
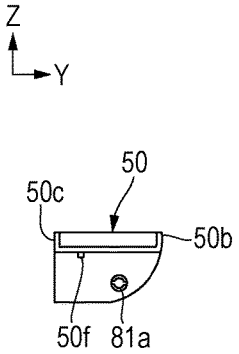
FIG. 12A is a sectional view of FIG. 11 along line V-V, in the direction of arrows.
Figure 12B:
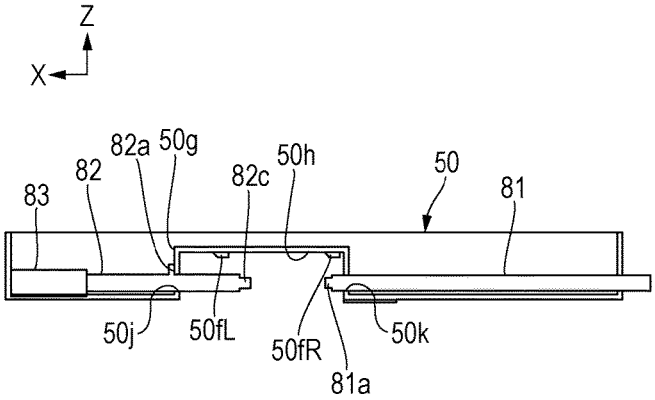
FIG. 12B is a sectional view of FIG. 11 along line W-W, in the direction of arrows.
Figure 12C:
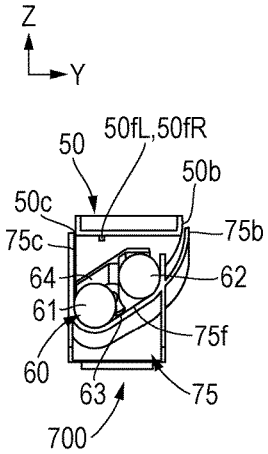
FIG. 12C is a sectional view of FIG. 11 along line V-V, in the direction of the arrows, when a sliding end portion of a slide shaft is inserted into a slide hole of a feed roller.
Figure 12D:
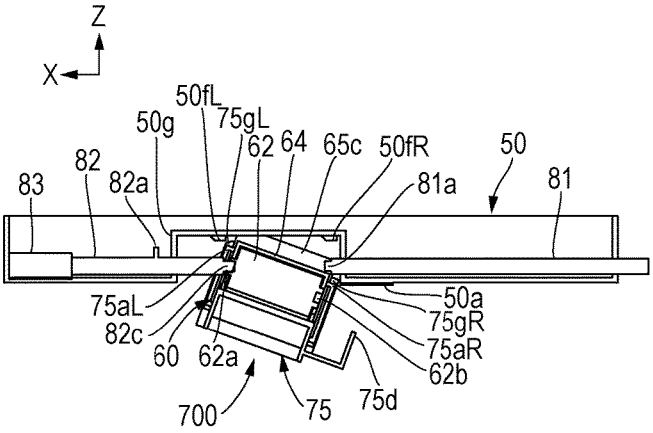
FIG. 12D is a sectional view of FIG. 11 along line W-W, in the direction of the arrows, when the sliding end portion of the slide shaft is inserted into the slide hole of the feed roller.

Installation of the supply unit 60 into the supply frame 50 of the sheet-supplying device 13 according to the second embodiment will now be described. FIG. 12A is a sectional view of FIG. 11 along line V-V, in the direction of arrows. FIG. 12B is a sectional view of FIG. 11 along line W-W, in the direction of arrows. FIG. 12C is a sectional view of FIG. 11 along line V-V, in the direction of the arrows, when the sliding end portion 82*c* of the slide shaft 82 is inserted into the slide hole 62*a* of the feed roller 62. FIG. 12D is a sectional view of FIG. 11 along line W-W, in the direction of the arrows, when the sliding end portion 82*c* of the slide shaft 82 is inserted into the slide hole 62*a* of the feed roller 62.

As illustrated in FIG. 12A to FIG. 12D, the roller-protecting member 75 (cover member) includes interference protruding portions 75*g*L and 75*g*R that can interfere with the protrusions 50*f*L and 50*f*R formed on the supply frame 50. When the supply unit 60 held by the engaging pawls 75*a*L and 75*a*R (engaging portions) of the roller-protecting member 75 is installed into the supply frame 50, the interference protruding portions 75*g*L and 75*g*R interfere with the protrusions 50*f*L and 50*f*R. The reaction force at this time acts against the engaging force of the engaging pawls 75*a*L and 75*a*R (engaging portions) engaging the engagement recessed portions 64*a*L and 64*a*R, causing the engaging pawls 75*a*L and 75*a*R to disengage from the supply unit 60.

The slide shaft 82 slides as a result of being urged in the −X direction by the coil spring 83. When the slide stopping portion 82*a* of the slide shaft 82 comes into contact with the slide-stopped portion 50*g* of the supply frame 50, the slide shaft 82 stops at the position illustrated in FIG. 12B. In this state, the slide shaft 82 is caused to slide in the direction of arrow X against the urging force of the coil spring 83, and the supply unit 60 installed as illustrated in FIG. 2A and FIG. 2B can thereby be detached from the sheet-supplying device 13.

As illustrated in FIG. 12C and FIG. 12D, the sliding end portion 82*c* of the slide shaft 82 is inserted into the slide hole 62*a* of the feed roller 62 of the supply unit 700 in the state illustrated in FIG. 12A and FIG. 12B. At this time, the positioning guiding portions 75*b* and 75*c* of the roller-protecting member 75 are in contact with the guided portions 50*b* and 50*c* of the supply frame 50, and movement of the supply unit 700 in the direction of arrow Y and in the opposite direction is thereby restricted. The position in the direction of arrow Z can be somewhat adjusted without restriction by visually inspecting the slide hole 62*a* and the sliding end portion 82*c* and adjusting accordingly. Accordingly, the restriction on the movement in the direction of arrow Y and in the opposite direction eliminates the misalignment of the slide hole 62*a* and the sliding end portion 82*c*, and the sliding end portion 82*c* can be readily inserted into the slide hole 62*a*.

Figure 13A:
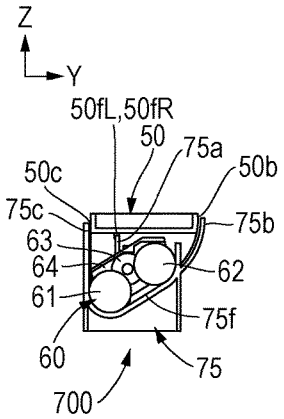
FIG. 13A is a sectional view of FIG. 11 along line V-V, in the direction of the arrows, before the supply unit is installed in a normal state with respect to the sheet-supplying device.
Figure 13B:
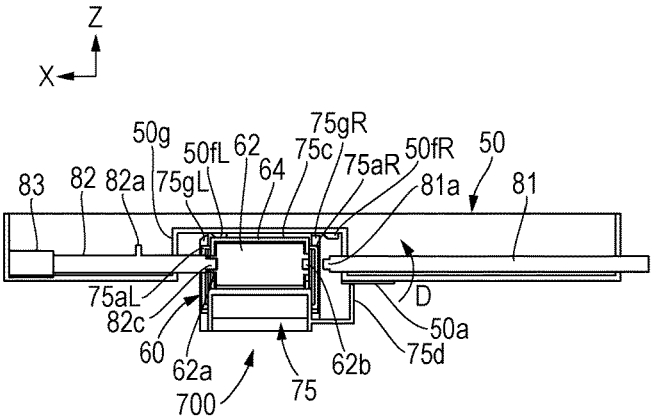
FIG. 13B is a sectional view of FIG. 11 along line W-W, in the direction of the arrows, before the supply unit is installed in a normal state with respect to the sheet-supplying device.
Figure 13C:
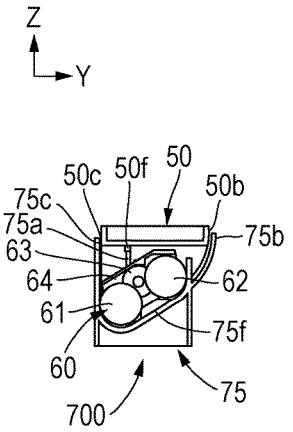
FIG. 13C is a sectional view of FIG. 11 along line V-V, in the direction of the arrows, when the supply unit is installed into the sheet-supplying device.
Figure 13D:
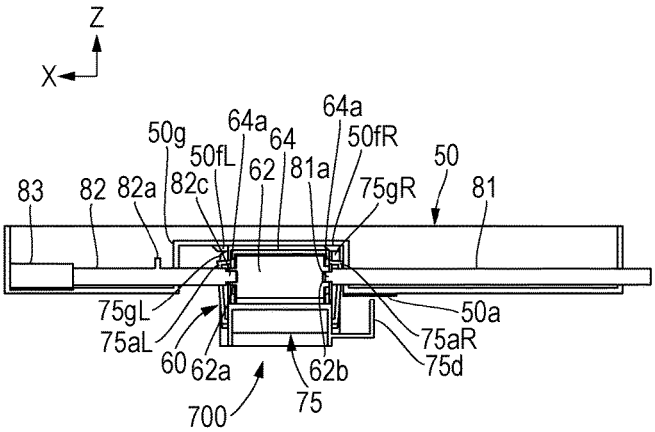
FIG. 13D is a sectional view of FIG. 11 along line W-W, in the direction of the arrows, when the supply unit is installed into the sheet-supplying device.

FIG. 13A and FIG. 13B are sectional views of FIG. 11 before the supply unit 700 is installed in a normal state with respect to the sheet-supplying device 13. In the state illustrated in FIG. 12C and FIG. 12D, the supply unit 700 is swung in the direction of arrow D (FIG. 13B) on the side of the supply drive shaft 81, for example, through manual operation while the supply unit 700 and the slide shaft 82 are caused to slide in the +X direction (direction of arrow X) against the urging force of the coil spring 83.

At this time, the positioning guiding portions 75*b* and 75*c* of the roller-protecting member 75 are in contact with the guided portions 50*b* and 50*c* of the supply frame 50, and the movement in the +Y direction and in the −Y direction is thereby restricted. The positioning restricting portion 75*d* of the roller-protecting member 75 is in contact with one of the restricted portions 50*a* of the supply frame 50, and the movement in the direction of arrow Z is thereby restricted. At this time, the engagement hole 62*b* of the feed roller 62 is coaxial with the engaging end portion 81*a* of the supply drive shaft 81, and accordingly, the engaging end portion 81*a* can readily engage the engagement hole 62*b* in a subsequent process.

When a user releases their grip to relieve the force acting against the urging force of the coil spring 83 in the state illustrated in FIG. 13A and FIG. 13B, the urging force of the coil spring 83 causes the supply unit 700 and the slide shaft 82 to move in the −X direction. In this way, the engaging end portion 81*a* of the supply drive shaft 81 properly engages the engagement hole 62*b* of the feed roller 62, and the supply unit 700 is installed into the sheet-supplying device 13 in a normal state.

At almost the same time, the two interference protruding portions 75*g*L and 75*g*R of the roller-protecting member 75 interfere with the two protrusions 50*f*L and 50*f*R formed on the upper surface of the recessed portion 50*h* of the supply frame 50, respectively. The interference creates a force acting against the engagement of the engaging pawls 75*a*L and 75*a*R of the roller-protecting member 75 and the engagement recessed portions 64*a*L and 64*a*R of the supply unit 60 (that is, a force that is transmitted through the interference protruding portions 75*g*L and 75*g*R and pushes the supply unit 60 downward). In this way, the engaging pawl 75*a*L disengages from the engagement recessed portion 64*a*L, and the engaging pawl 75*a*R disengages from the engagement recessed portion 64*a*R. Consequently, the roller-protecting member 75 is detached from the supply unit 60, and in this state, only the supply unit 60 is installed into the supply frame 50.

With the above structure, the surface of the pickup roller 61 is not touched and a supply failure can be inhibited during installation (replacement) using the supply unit 700. In addition, the roller-protecting member 75 functions as a guide during installation. This facilitates the operation by an operator and enables the operator to avoid a failure in installation. The roller-protecting member 75 is automatically detached from the supply unit 60 during installation.

This further facilitates the installation and enables an operator to inhibit from forgetting to detach the roller-protecting member 75.

In the second embodiment, the interference protruding portions 75gL and 75gR that can interfere with the protrusions 50fL and 50fR formed on the supply frame 50 are formed. When the supply unit 60 held by the engaging pawls 75aL and 75aR is installed into the supply frame 50, the reaction force produced when the interference protruding portions 75gL and 75gR interfere with the protrusions 50fL and 50fR acts against the engaging force of the engaging pawls 75aL and 75aR engaging the recessed portions 64aL and 64aR. Accordingly, the roller-protecting member 75 is readily detached from the supply unit 60, and the detachment of the roller-protecting member 75 becomes easier.

The above embodiments are described by using the image forming apparatus 100 that is of an electrophotographic type. Alternatively, the embodiments can be applied to, for example, an ink-jet image forming apparatus that forms an image on a sheet by discharging ink from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-217188, filed Nov. 5, 2015, which is hereby incorporated by reference herein in its entirety.

What is claimed is:

1. A supply unit that is to be installed into an image forming apparatus, comprising:

a supply member that supplies a sheet;

a unit body that includes an engaged portion to be engaged and supports the supply member; and a cover member that includes a cover portion that covers the supply member and an engaging portion that is to engage the engaged portion, wherein the supply unit is installed into the image forming apparatus with the engaging portion engaging the engaged portion and the cover portion covering the supply member, the cover member being detachable from the supply unit in a state in which the supply unit has been installed into the image forming apparatus.

2. The supply unit according to claim 1, wherein the supply member is a supply roller that is rotatable about a shaft.

3. The supply unit according to claim 2, further comprising:

a conveyance member that conveys the sheet supplied by the supply member to a downstream side in a direction in which the sheet is conveyed, wherein the unit body integrally holds the conveyance member and the supply member.

4. The supply unit according to claim 3, wherein the cover member includes an interference portion that comes into contact with and interferes with part of the image forming apparatus, and wherein the engaging portion disengages from the engaged portion in a manner in which the interference portion of the cover member interferes with the part of the image forming apparatus when the supply unit is installed into the image forming apparatus.

5. An image forming apparatus comprising:

an installation portion; and a supply unit that is to be detachably installed into the installation portion and includes a supply member that supplies a sheet, a unit body that includes an engaged portion to be engaged and supports the supply member, a cover member that includes a cover portion that covers the supply member and an engaging portion that is to engage the engaged portion, wherein the supply unit is installed into the installation portion with the engaging portion engaging the engaged portion and the cover portion covering the supply member, the cover member being detachable from the supply unit in a state in which the supply unit has been installed into the image forming apparatus.

6. The image forming apparatus according to claim 5, wherein the supply member is a supply roller that is rotatable about a shaft.

7. The image forming apparatus according to claim 6, further comprising:

a conveyance member that conveys the sheet supplied by the supply member to a downstream side in a direction in which the sheet is conveyed, wherein the unit body integrally holds the conveyance member and the supply member.

8. The image forming apparatus according to claim 7, wherein the installation portion includes a first support shaft that is urged such that a sliding end portion thereof is to be inserted into a slide hole formed in one end portion of the conveyance member, and a second support shaft including an engaging end portion that is to engage an engagement hole formed in the other end portion of the conveyance member, and wherein the supply unit is installed into the installation portion with the conveyance member interposed therebetween in a manner in which the sliding end portion is inserted into the slide hole of the conveyance member and the engaging end portion is inserted into the engagement hole of the conveyance member.

9. The image forming apparatus according to claim 7, where the cover member is detached from the supply unit by using an operator-applied operating force acting against an engaging force of the engaging portion engaging the engaged portion.

10. The image forming apparatus according to claim 7, wherein the cover member includes an interference protruding portion that is to interfere with a protrusion formed on the installation portion, and, when the supply unit held by the engaging portion is installed into the installation portion, a reaction force produced when the interference protruding portion interferes with the protrusion acts against an engaging force of the engaging portion engaging the engaged portion, and the cover member is detached from the supply unit.

11. The image forming apparatus according to claim 7, wherein the cover member includes a positioning contact portion that sets a position of the supply unit with respect to the installation portion by making contact with the installation portion when the supply unit held by the engaging portion is installed into the installation portion.

12. The image forming apparatus according to claim 7, further comprising:

a sheet-containing unit that is to be installed into and to be drawn from the image forming apparatus and is configured to contain the sheet to be supplied by the supply member; and an image-forming unit that forms an image on the sheet supplied from the sheet-containing unit, wherein the installation portion is formed such that, in a case where the cover member is not detached from the supply unit, the cover member is located on a track of the sheet-containing unit to be installed when the sheet-containing unit is drawn from the image forming apparatus, and the cover member interferes with the sheet-containing unit when the sheet-containing unit is installed.

* * * * *